US006023788A

United States Patent [19]

McCallum et al.

[11] Patent Number: 6,023,788

[45] Date of Patent: *Feb. 15, 2000

[54] HAT WITH STORAGE POCKET

[76] Inventors: Timothy P. McCallum, 6709A Vista Del Mar, La Jolla, Calif. 92037; Frank C. Del Pizzo, Jr., 1355 Roswell Rd., Suite 480, Marietta, Ga. 30062

[ * ] Notice: This patent is subject to a terminal disclaimer.

[21] Appl. No.: 09/037,718

[22] Filed: Mar. 9, 1998

Related U.S. Application Data

[63] Continuation-in-part of application No. 08/578,989, Dec. 27, 1995, Pat. No. 5,724,678.

[51] Int. Cl.[7] ..... A42C 5/00

[52] U.S. Cl. ..... 2/209.13; 2/181; 2/181.4; 2/195.1

[58] Field of Search ..... 2/181, 195.1, 209.13, 2/181.2, 181.4

[56] References Cited

U.S. PATENT DOCUMENTS

| | | |
|---|---|---|
| D. 160,404 | 10/1950 | Levine . |
| 1,172,927 | 2/1916 | Bloch . |
| 1,190,427 | 7/1916 | Kromer, Jr. . |
| 1,422,435 | 7/1922 | Gooding . |
| 1,575,130 | 3/1926 | Schiff . |
| 1,808,966 | 6/1931 | Morgan . |
| 2,597,447 | 5/1952 | Bruns . |
| 2,615,168 | 10/1952 | Tannenbaum . |
| 2,708,273 | 5/1955 | Bonaventura . |
| 2,744,256 | 5/1956 | Slotkin et al. . |
| 3,128,474 | 4/1964 | Feldman . |
| 3,285,307 | 11/1966 | Dormaier . |
| 4,165,542 | 8/1979 | McLaughlin . |
| 4,312,076 | 1/1982 | Gamm . |
| 4,317,238 | 3/1982 | Amin . |
| 4,386,437 | 6/1983 | Fosher . |
| 4,451,935 | 6/1984 | Henschel . |
| 4,472,837 | 9/1984 | Saxton . |
| 4,586,280 | 5/1986 | Dane . |
| 4,610,038 | 9/1986 | Dennard . |
| 4,630,317 | 12/1986 | Brown et al. . |
| 4,776,043 | 10/1988 | Coleman . |
| 4,873,726 | 10/1989 | Tapia . |
| 4,899,887 | 2/1990 | Cachero . |
| 4,989,270 | 2/1991 | Boughten . |
| 5,070,545 | 12/1991 | Tapia . |
| 5,075,898 | 12/1991 | Bedient . |
| 5,111,366 | 5/1992 | Rife et al. . |
| 5,119,514 | 6/1992 | Woehl . |
| 5,136,726 | 8/1992 | Kellin et al. . |
| 5,167,559 | 12/1992 | Power-Fardy . |
| 5,173,970 | 12/1992 | Shifrin . |
| 5,214,802 | 6/1993 | McCallum . |
| 5,233,703 | 8/1993 | Galka . |
| 5,367,713 | 11/1994 | McCallum . |
| 5,410,761 | 5/1995 | Connelly et al. . |
| 5,428,844 | 7/1995 | Dougherty . |
| 5,452,479 | 9/1995 | Mostert . |
| 5,459,881 | 10/1995 | Fagan et al. . |
| 5,465,426 | 11/1995 | Beaton . |
| 5,477,629 | 12/1995 | Gleason, Jr. . |
| 5,509,145 | 4/1996 | Stevenson et al. . |
| 5,704,070 | 1/1998 | Stogner . |
| 5,724,678 | 3/1998 | McCallum et al. . |

FOREIGN PATENT DOCUMENTS

| | | |
|---|---|---|
| 1472626 | 3/1967 | France . |
| 139374 | 3/1920 | United Kingdom . |

*Primary Examiner*—Diana Oleksa
*Attorney, Agent, or Firm*—Brown, Martin, Haller & McClain, LLP

[57] ABSTRACT

A hat has a storage pocket on the inside of the hat which is located entirely within a dead space at the front portion of the hat extending from a location spaced above a hat band towards the crown of the hat. When a hat is worn, there will be a dead space inside the hat where the hat does not contact the wearer's head, which typically extends from a location just above the hat band to the crown of the hat, due to the difference in curvature between the wearer's head and the hat itself. By positioning a storage pocket in this area, unsightly bulges are avoided, as well as discomfort due to stored items pressing against the wearer's head.

32 Claims, 4 Drawing Sheets

HAT WITH STORAGE POCKET

CROSS-REFERENCE TO RELATED APPLICATION

This application is a Continuation-In-Part of our application Ser. No. 08/578,989 filed Dec. 27, 1995, now U.S. Pat. No. 5,724,678.

BACKGROUND OF THE INVENTION

The present invention relates generally to hats, and is particularly concerned with a hat having a storage space or pocket for storage purposes.

Hats with pockets are known. For example, U.S. Pat. No. 4,165,542 of McLaughlin describes a hat with a pocket on the inside into which the hat can be inserted for easy carrying when not in use. The pocket has a lower end at the rim of the hat and an upper end adjacent the crown. When the hat is worn, small items may be inserted for carrying purposes. However, since the lower end of the pocket is at the rim of the hat, such items will fall down to the rim, where they will bear against the wearer's head and may cause some discomfort. In U.S. Pat. No. 5,214,802 of McCallum, a convertible hat and bag assembly is described, which has two layers, one of which acts as a hat when it is outermost and the other of which acts as a bag when outermost. An opening in one layer provides access to the space between the two layers for storage purposes. However, items stored in this space will fall down to the rim area when the assembly is worn as a hat, causing discomfort and also bulges which may detract from the appearance of the hat.

SUMMARY OF THE INVENTION

It is an object of the present invention to provide a new and improved hat with a storage pocket.

According to the present invention, a hat is provided which comprises a head covering member having a headband for encircling the head of a wearer, an outer face, an inner face, a crown, a front portion, a rear portion, and opposite side portions, a pocket secured to the inner face of the head covering member, the pocket having an access opening and being located in the front portion of the head covering member, the pocket extending from the access opening upwardly towards the crown of the head covering member so that at least the majority of the pocket is located in a dead space of the hat which will not contact the wearer's head when the hat is worn, and a releasable fastener mechanism for releasably closing the pocket opening.

When a hat is worn on a wearer's head, the hat will not be in contact with the head over its entire area. Typically, the hatband or sweatband contacts around the periphery of the head, but due to the difference in curvature between the person's forehead and the front portion of the hat, there will be a dead space between the hat and forehead, extending from a location just above the sweatband or hatband up to the crown of the head. According to this invention, a pocket is positioned entirely within this dead space so that items placed in the pocket do not bear against the wearer's head and cause discomfort. Also, items in the pocket will not cause bulges on the outside of the hat, and will therefore not detract from its appearance.

Preferably, a pull tab is secured to the pocket adjacent the opening, for pulling by a user to easily open the pocket. The releasable closure mechanism may comprise mating strips of Velcro® on opposite sides of the pocket opening, or may alternatively comprise a zipper, snap fasteners, or the like.

The head covering member may comprise a single layer or an outer layer and an inner layer. The inner layer may be of mesh or other cool, lightweight material, and may extend only over the front portion of the hat or over the entire outer layer of the hat. Where the hat covering member is a single layer, the pocket may be releasably or permanently secured to the inside of the hat layer. Where an inner layer is provided, the pocket may be secured between the two layers with an opening in the inner layer around which the opening in the pocket is secured. The inner layer may be releasably secured to the hat so that it may be removed for use as a clutch bag or the like separate from the hat. In the latter case, the inner layer is preferably secured around its periphery to the outer layer via mating strips of hook and loop type fastener material, such as Velcro®. Waist straps may be provided for releasably securing to the removed inner layer so that it may be used as a waist pack or the like. The waist straps are preferably provided with mating fastener material for mating with the same strip of fastener material which would otherwise be used for securing the inner layer to the outer layer of the hat. Thus, if something is to be carried which is too large for the pocket, the entire inner layer of the hat may be removed for use as a clutch or waist pack.

Preferably, where the pocket is secured to a separate inner layer or liner of the hat, the liner is secured to the crown of the hat via a button or the like extending through both layers of the cap. This will act to hold the pocket up and prevent sagging, and will also hold the contents of the pocket away from the head to avoid discomfort.

The pocket opening has a width substantially equal to the width of the front portion of the hat and preferably does not extend over the sides of the hat. Preferably, the depth of the pocket is such that it extends up to the crown or just past the crown of the hat. The pocket may be of waterproof material or may have a waterproof insert for items which may be damaged by moisture. The pocket may be formed entirely separately from the head covering member, or the single layer or inner layer may form an inner wall of the pocket, with the outer wall of the pocket sewn around its periphery apart from the opening to the underlying hat layer or liner layer.

The pocket may be permanently secured to the hat at only one end, either the open or closed end of the pocket, and releasably secured to the hat at the opposite end and also along the sides, if desired. With this arrangement, the pocket may be folded up or down away from the front panel of the hat while the front panel is custom embroidered, and then re-attached after the embroidery is completed.

The hat with a storage pocket allows small items such as money, keys, credit cards and the like to be stored conveniently when walking, running, surfing or the like. The positioning of the pocket is such that the stored items will not bear against the wearer's head and cause discomfort, since they are located in a dead space of the hat where it does not contact the wearer's head. Also due to the pocket positioning, the stored items will not cause any bulges on the outside of the hat which could otherwise detract from its appearance.

BRIEF DESCRIPTION OF THE DRAWINGS

The present invention will be better understood from the following detailed description of some preferred embodiments of the invention, taken in conjunction with the accompanying drawings, in which like reference numerals refer to like parts, and in which.

DESCRIPTION OF THE PREFERRED EMBODIMENTS

Figure 1:
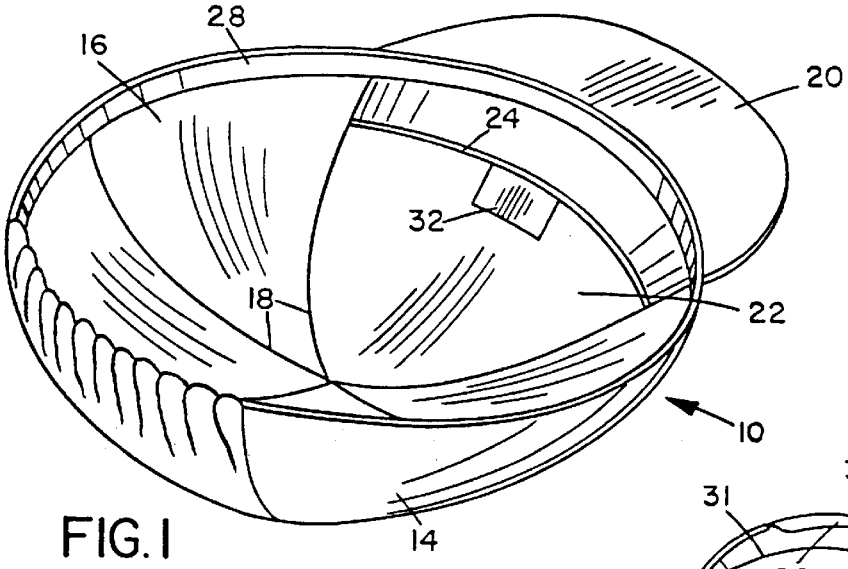
FIG. 1 is a perspective view of a hat with a built-in storage pocket according to a first embodiment of the invention.
Figure 2:
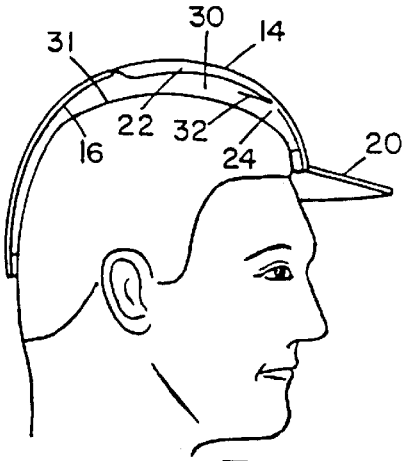
FIG. 2 is a side elevation, partially in section, illustrating the positioning of the hat of FIG. 1 on a wearer's head.
Figure 3:
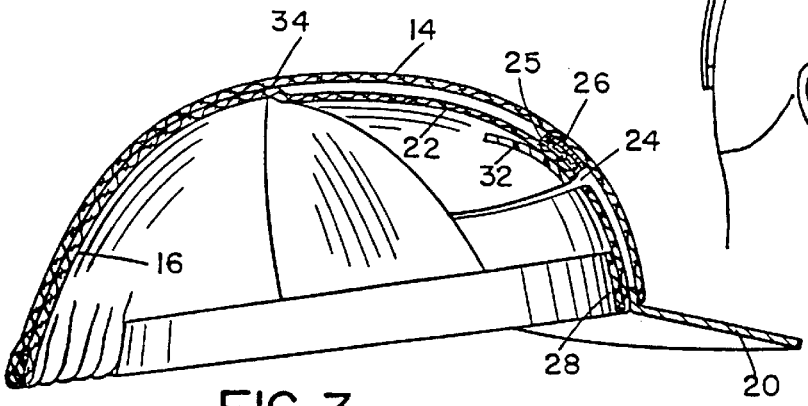
FIG. 3 is a section on the lines 3—3 of FIG. 1.

FIGS. 1 to 3 of the drawings illustrate a hat or cap 10 according to a first embodiment of the invention which has an integral pocket 22. Hat 10 has an outer layer 14 and an inner layer or liner 16 which is sewn to the outer layer along the periphery of the hat and also seams 18 dividing the interior of the hat into generally triangular segments, as best illustrated in FIG. 1. A brim or bill 20 is secured along a forward edge of the hat in a conventional manner so as to project outwardly from a wearer's head as generally illustrated in FIG. 2. Pocket or storage space 22 is formed between the outer layer 14 and liner 16 in a forward triangular segment of the hat, with an access opening 24 provided in liner layer 16 to provide access to pocket 22. The adjacent seams 18 define the periphery of the pocket. The inner and outer layers will also be sewn together along one edge of opening 24, as illustrated in FIG. 3, so that the pocket does not extend down to sweatband 28. A suitable fastener device is provided for releasably closing pocket opening 24, such as a zipper, snap fasteners, or the like. In the preferred embodiment, opposing strips 25, 26 of mating hook and loop type fastener material, such as Velcro® are provided along opposing edges of opening 24, as best illustrated in FIG. 3.

As illustrated in FIGS. 1 and 2, opening 24 is spaced above hat sweatband 28. When the hat is worn, there will be a dead space 30 between the hat and the wearer's forehead 31, due to the difference in curvature between the hat and the wearer's head. The pocket 22 is appropriately positioned so that it will be substantially completely located within the dead space 30 when the hat is worn, as illustrated in FIG. 2. By locating the pocket in this position, items placed in the pocket will not bear against the wearer's head, avoiding potential discomfort. Also, items in the pocket will not cause bulges on the outside of the hat, which could potentially detract from the appearance of the hat.

The pocket 22 in FIGS. 1 to 3 has a downwardly facing opening. However, the pocket may alternatively be provided with an upwardly facing opening adjacent the crown of the hat, with an appropriate seam being provided at the location of opening 24 in FIG. 1 to define the lowermost portion of the pocket and ensure that items do not fall down to the headband or sweatband 28.

A pull tab 32 is secured to the liner layer adjacent the pocket opening 24, as best illustrated in FIGS. 1 and 2, to enable the user to open the pocket more easily. Seams 18 secure the liner layer to the outer layer of the hat up to the button or crown 34, ensuring that the pocket is held up and does not slip down against the wearer's head due to the weight of items in the pocket. Alternatively a separate pocket 22 may be secured to an opening in a liner layer which is not secured to the outer layer along seams 18, but only along the periphery of the hat, for example. In this case, the liner layer will be additionally secured to the outer hat layer at the button or crown 34, for example by stitching or the like.

Figure 5:
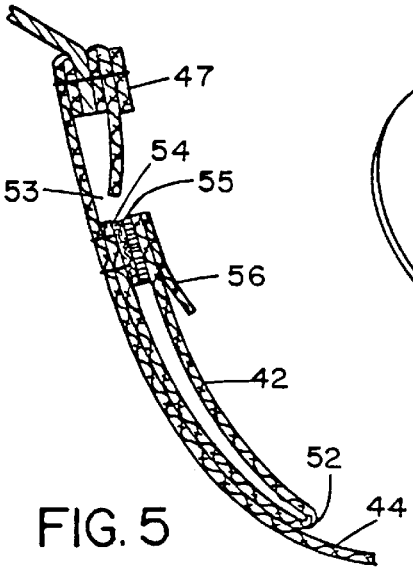
FIG. 5 is a section through a front portion of the hat on the lines 5—5 of FIG. 4.
Figure 4:
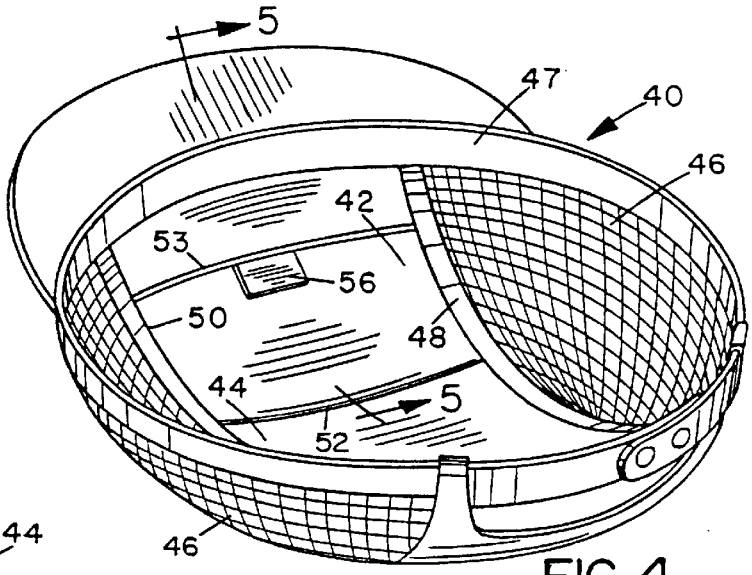
FIG. 4 is a perspective view of a hat with a pocket according to a second embodiment of the invention.

FIGS. 4 and 5 illustrate an alternative, single layer hat 40 with a pocket 42, according to a second embodiment of the invention. Single layer hats are often used by participants in sporting activities such as running or cycling. This type of hat will be much cooler and is therefore preferable to the double layer hat of the first embodiment when performing sporting or other arduous activities.

Hat 40 has a central, solid panel 44 of a suitable material such as cotton, and two side panels 46 of mesh material to allow air flow and cooling of the wearer's head. Alternatively, panels 46 may also be of a solid material with no openings. A conventional sweat band 47 is sewn around the peripheral edge of the hat. Pocket 42 is made from a separate piece of material which is folded in half and is sewn along two side seams 48, 50 to the solid panel 44 at a location spaced above sweat band 47. Pocket 42 has a closed end or fold 52 adjacent the crown of the hat and an opening 53 facing downwardly towards the sweatband. A suitable releasable fastener mechanism is provided for closing opening 53, such as a zipper, snap fasteners or the like, or opposing strips 54, 55 of mating hook and loop type fastener material, such as Velcro®, as best illustrated in FIG. 5. As in the previous embodiment, a pull tab or handle tab 56 is provided for allowing the pocket to be readily opened.

As in the previous embodiment, pocket 42 is located within the dead space of the hat, so that it will be positioned away from the wearer's head as the hat is worn, and items in the pocket will not cause the wearer any discomfort, nor detract from the outer appearance of the hat.

Instead of forming pocket 42 entirely from a separate piece of material as illustrated in FIGS. 4 and 5, panel 44 may form one side of the pocket and a single piece of material may be sewn along three sides to panel 44 to form the other side of the pocket, in an equivalent position to pocket 42 in FIGS. 4 and 5. Additionally, the pocket may be reversed if desired, with the opening 53 located along edge 52 and the closed end of the pocket being positioned adjacent sweat band 47.

Figure 6:
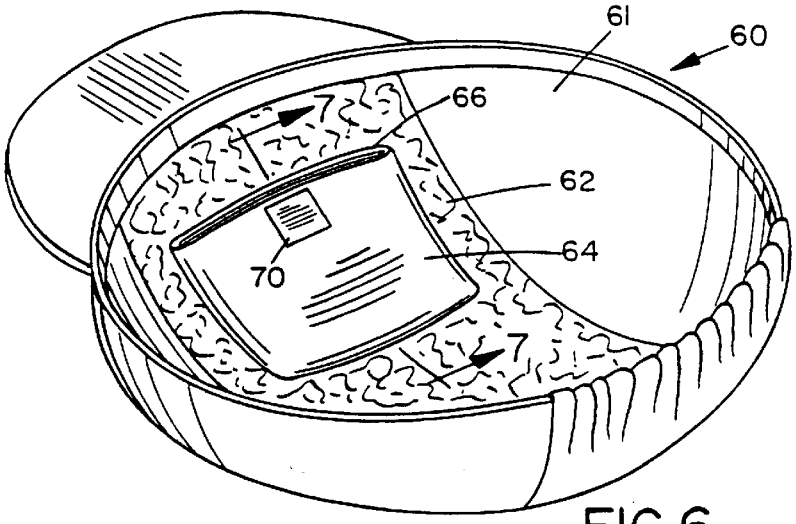
FIG. 6 is a perspective view of a hat with an attached pocket according to a third embodiment of the invention.
Figure 7:
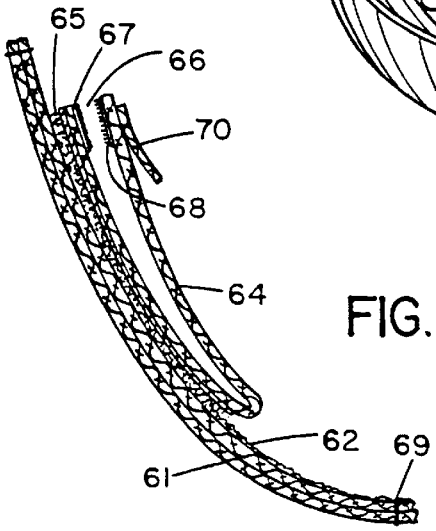
FIG. 7 is a section through the front of the hat on the lines 7—7 of FIG. 6.

FIGS. 6 and 7 illustrate another alternative embodiment of the invention in which a hat 60 of the same general style as the previous embodiments has an outer layer 61 and a partial liner layer 62 of nylon tricot loop material. Layer 62 may extend over the entire inner surface of the hat, if desired, or may be provided as a tape or strip sewn along the hat seams. Nylon tricot loop material is soft enough to form a liner layer for a hat, but will releasably adhere to Velcro® hook material while being softer and more flexible than conventional Velcro® loop material.

A separate pocket 64 is provided with a layer 65 of Velcro® hook material secured to one face of the pocket. Pocket 64 has an opening 66 releasably closed by opposing strips 67, 68 of Velcro® hook and loop material, as in the previous embodiments, or may alternatively be closed by a zipper, snap fasteners, or the like. The pocket layer 65 is simply pressed against the layer 62 so that the hook and loop formations releasably adhere to one another to secure the pocket on the inside of the hat. The layer 62 is additionally secured to the hat at the crown or button by stitching 69, or alternatively by riveting or the like, so that the weight of the pocket and contents do not cause the hat to sag. A pull tab 70 may be provided for easy opening of pocket 64, as in the previous embodiments.

With this arrangement, the pocket may be removed from the hat when desired to insert items into the pocket or remove items from the pocket, or when the pocket is to be carried by hand, and may then be readily re-adhered to the inside of the hat when the hat is to be worn. The loop material liner layer may be partial or extend over the entire hat, or just along the hat seams, but must permit the pocket to be adhered to the hat so as to be located in the dead space when the hat is worn, as in the previous embodiments.

Figure 9:
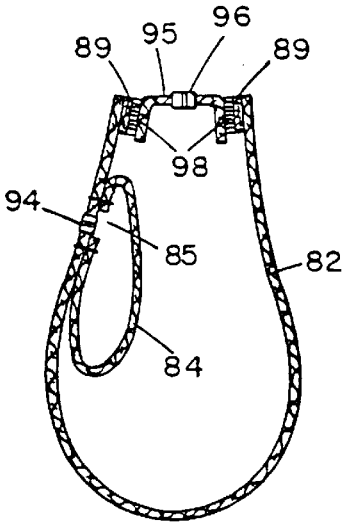
FIG. 9 illustrates the liner of FIG. 8 removed from the hat and reversed to provide a bag.
Figure 8:
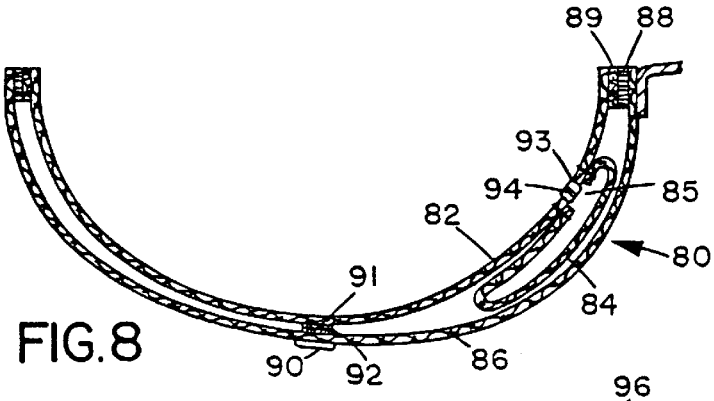
FIG. 8 is a sectional view similar to FIG. 3 illustrating a hat and pocket according to a fourth embodiment of the invention.
Figure 10:
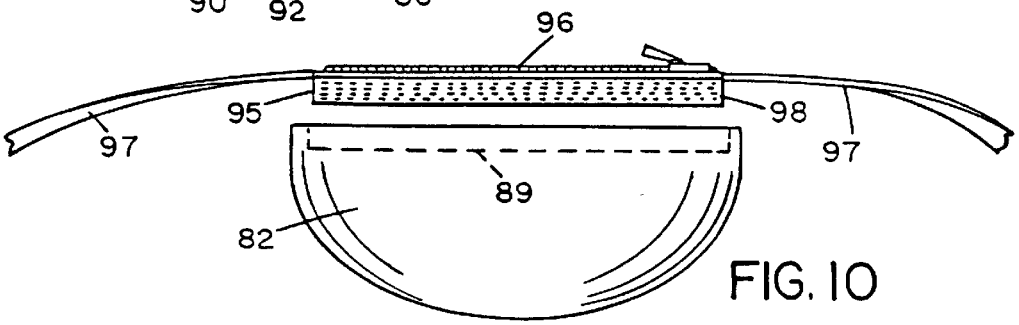
FIG. 10 is a perspective view of the bag of FIG. 9 with a closure member and waist straps attached.

FIGS. 8 to 10 illustrate another alternative embodiment in which hat 80 has a removable liner layer 82 having a pocket 84. Liner layer 80 is releasably secured around the periphery of the outer hat layer 86 by suitable strips 88, 89 of mating, hook and loop type Velcro® material extending around the inner periphery of outer layer 86 and the outer periphery of liner layer 82, as illustrated in FIG. 8. The layer 80 is preferably also releasably secured to the outer layer 86 at the crown or button 90 by a releasable snap fastener or by mating patches 91, 92 of hook and loop fastener material.

Liner layer 82 is provided with a slot or slit-like opening 93 positioned at an equivalent location to opening 24 in the first embodiment, and the pocket 84 has an opening 85 which is suitably sewn around the periphery of opening 24. Pocket 84 may be closed by a zipper 94 or other releasable fastener, or may have opposing strips of hook and loop type fastener material as in the previous embodiments. As illustrated in FIG. 8, the pocket will be located in the dead space of the hat. Slumping of the pocket and liner layer may be reduced by releasably securing the liner layer to the crown of the hat, ensuring that the pocket and its contents remain within the dead space.

The liner layer 82 may be removed from the hat if desired and may then be carried as a clutch bag. Alternatively, the liner layer may be removed from the hat, and turned inside out as in FIG. 9 so that the hook type Velcro® strip faces inwardly, and the pocket opening 85 faces outwardly. A closure or fastener strip 95 is provided for releasably closing the opening of the reversed liner layer 82, as best illustrated in FIGS. 9 and 10. Closure strip 95 has a central, elongate region having a slit opening closable by means of a zipper fastener 96 extending along the opening, and waist straps 97 extending from the central region for enabling the bag to be secured around a wearer's waist. Flaps 98 of loop type Velcro® material are secured along opposite sides of the central region of strip 95, for mating with opposing portions of the strip 89 extending along the rim of the reversed liner layer 82, as illustrated in FIG. 9. Thus, the closure strip 95 can be used to close the opening formed when liner layer 82 is reversed and opposing portions of the peripheral edge of liner layer 82 are urged towards each other to form a bag. Zipper fastener 96 then provides access to the interior of the bag, while fastener 94 on the outside of the resultant bag still provides access to the smaller pocket.

This arrangement is particularly convenient since it allows the hat to be worn while smaller items are stored in pocket 84 as well as alternatively allowing the removable liner layer and pocket to be separated from the hat and used as a separate bag for storing larger items, while the hat can still be worn without the liner layer.

The pocket of this invention may be formed by portions of the existing hat outer and liner layers, where a hat has a separate liner layer, simply by appropriately sewing the outer and liner layers together to form three sides of the pocket and providing an opening in the liner layer for access to the pocket. One example of this alternative is illustrated in FIGS. 1 to 3. Alternatively a separate pocket layer may be sewn between the outer and liner layers in an equivalent location. In this case, the liner layer is preferably permanently or releasably secured to the button or crown of the outer layer, to help prevent the pocket and liner layer from slumping down onto the wearer's head due to heavy items in the pocket.

Figure 11:
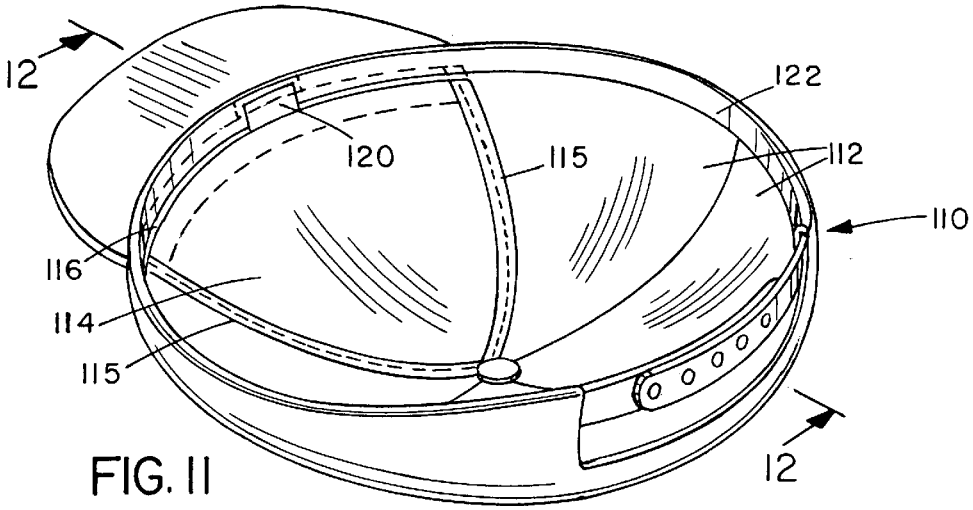
FIG. 11 is a perspective view of the inside of a hat with a storage pocket according to another embodiment of the invention.
Figure 12:
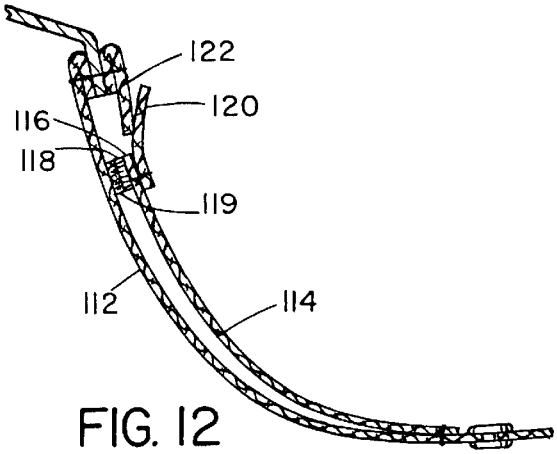
FIG. 12 is a section on the likes 12—12 of FIG. 11.

If the hat is of single layer construction, a separate pocket may be suitably secured to the inner surface of the hat at an appropriate position, or may be releasably secured to the inner surface as in FIGS. 6 and 7. The inner surface of the hat may form one side of the pocket, with a single piece of material sewn to the inner surface to form the other side of the pocket, as illustrated in FIGS. 11 and 12. Alternatively, the pocket may be formed by a single piece of material folded and sewn along two sides to the hat, as in FIGS. 4 and 5. If desired, the pocket may have a waterproof liner layer so that the contents of the pocket can be kept dry in all weather conditions, and also can be protected from sweat. A waterproof liner is particularly desirable for pockets installed in runner's or cyclists hats, for example, or for hats used in water sports such as yachting and windsurfing. In the latter case, the bill of the hat may be of suitable foam material for flotation purposes.

As described above, FIGS. 11 and 12 illustrate an embodiment in which hat 110 is of single layer construction, formed from a plurality of triangular panels 112, and the pocket is formed from a single, triangular pocket forming layer 114 which is sewn along the panel seams 115 to cover the front two triangular panels of the hat. The lower edge 116 of the triangular panel or layer 114 is releasably secured to the underlying hat panels by means of mating strips 118, 119 of hook and loop type fastener material applied to the inside of edge 116 and to the underlying hat panels, as best illustrated in FIG. 12. Alternatively, a separate strip of material may be sewn in between the lower edge 116 of the pocket layer and the hat panels, and the fastener strip may be sewn to the intervening strip, to avoid having to stitch through the stiffer, front panels of the hat. A pull tab 120 is secured to the outer side of layer 114 adjacent the lower edge, to enable the user to pull the pocket open easily, as in the previous embodiments. By sewing the pocket forming layer along the hat panel seams, manufacture of the hat is simplified since a single seam sewing operation can simultaneously secure the pocket to the inside of the hat, as is also the case with the embodiments of FIGS. 1 to 5.

The lower edge or opening of the pocket is shown to be adjacent the sweat band 122 in FIGS. 11 and 12. It may alternatively be positioned behind the sweatband, so as to conceal the pocket opening and pull tab when the hat is in use. As illustrated in dotted outline in FIG. 11. In use, the user simply pulls the pocket open by pulling tab 120, and then can insert small items into the pocket to keep them safe while the hat is worn. The items will be held away from the user's head in the dead space of the hat, as described in connection with the previous embodiments, so that the wearer will not experience any discomfort, and the appearance of the hat will not be detrimentally affected.

Figure 13:
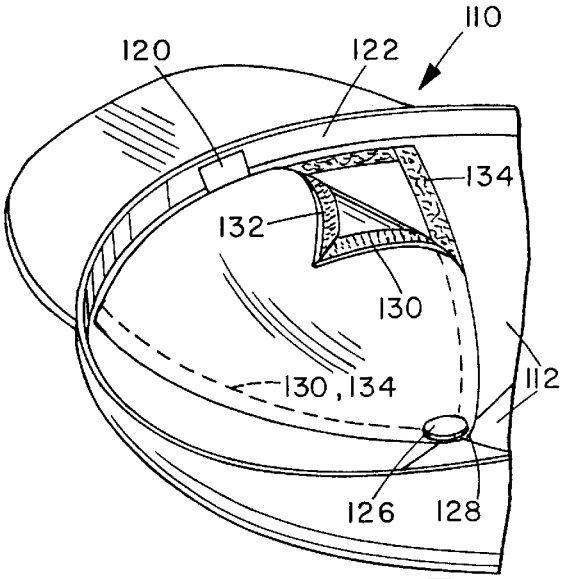
FIG. 13 is a partial view similar to FIG. 11 illustrating a modified, partially removable pocket.

FIG. 13 illustrates a modification of the hat 110 of FIGS. 11 and 12 in which like reference numerals have been used for like parts. The hat 110 may be of single layer construction, or may have a liner layer. In this modification, as in the previous embodiment, the pocket is formed from a single pocket forming layer 124. However, unlike the previous embodiment, layer 124 is permanently secured to the hat only at the button 126, where the apex 128 is sewn to the crown of the hat. Strips 130 of Velcro hook material or other fastener material are sewn along the inner side edges 131 of the layer 124, and a lower edge strip 132 of the same material is sewn along the lower edge of layer 124. Mating strips 134, 135 of loop type Velcro material are sewn along the side seams 115 of the hat as well as between the side seams for releasable engagement with lower edge strip 132. As in the previous embodiment, a pull tab 120 is provided, both for pulling the lower edge of layer 124 away from the underlying fastener strip 135 to obtain access to the interior of the pocket, and also to pull away the entire pocket layer 124 from the hat panels, so that it is attached only at the button.

The reason for making the entire pocket layer detachable, apart from a permanent connection at the button of the hat, is for ease in custom embroidering of the front panels. Often, blank hats are ordered in large numbers from a manufacturing facility, while smaller numbers of the blank hats are custom embroidered at a different facility. Existing embroidering machinery could not be used to embroider the front panel of a hat with a built-in internal pocket as in FIGS. 1 to 5 and 8 to 12. However, by making the pocket layer substantially detachable, it can be pulled up and away from the inside of the hat while embroidery is stitched through the front panels, and then folded back against the hat and attached via the fastener strips 130, 132, 134, and 135 to provide a functional pocket.

Figure 14:
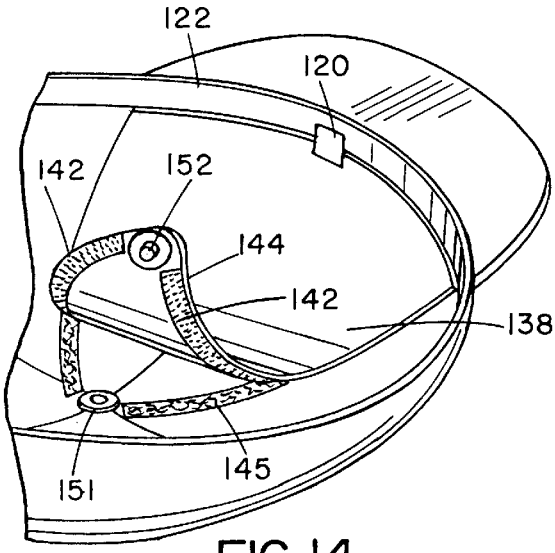
FIG. 14 is a view similar to FIG. 13 illustrating a modified pocket.
Figure 15:
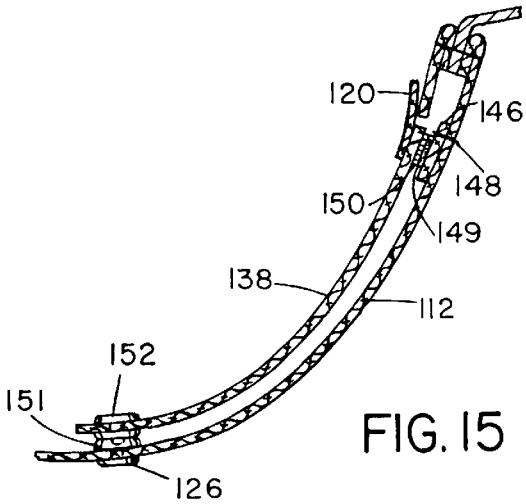
FIG. 15 is a cross-sectional view, similiar to FIG. 12, of the hat of FIG. 14.

There are many alternative ways in which a partially detachable pocket may be attached to the inside of a hat. The pocket may be a single or double layer, and may be attached to a single layer hat or a hat with a liner. FIGS. 14 and 15 illustrate a modified arrangement in which a single, pocket forming layer 138 is releasably secured to the button or crown 126 by a snap fastener assembly 140, and the side edges 142 are releasably secured along the hat seams 115 by means of mating strips 144, 145 of hook and loop type fastener material. A lower end piece 146 of the same material as pocket layer 138 is permanently secured to the hat panels via stitching 148 adjacent the peripheral edge of the hat. The lower edge of pocket layer 138 is releasably secured to end piece 146 via mating strips 149, 150 of hook and loop fastener material, to provide access to the interior of the pocket formed between layer 138 and the underlying hat panels 112. Again, a pull tab 120 is provided for ease in opening the pocket.

The snap fastener assembly 140 may comprise a first, snap recess or indent 151 formed on the inner part of the existing cap button 126, and a second, snap pin part 152 secured to the apex of the pocket layer 138 for snap engagement in indent 151. Alternatively, the assembly 140 may be formed in three parts, comprising the inner part of button 126, a second, snap part having a thumb tack for securing to the inner part of button 126, and a third snap part for snap engagement with the second part. Any type of interengageable snap formation may be used for the mating parts of the snap fastener.

With this arrangement, as in the previous embodiment, the pocket layer may be partially detached and moved away from the cap panels during embroidery. In this case, the layer 138 is first detached at the snap fastener, as indicated in FIG. 14, and is then peeled downwardly away from the hat to detach the strips 144 from the side strips 145 so that the pocket layer is completely separated from the majority of the front section of the hat, apart from along the stitching line 148. Once embroidery is complete, the pocket layer is folded back up and the snap part 152 is snapped into the cap button, while the side edges of the pocket are pressed down to secure strips 144 to the mating strips 145 on the inner face of the hat or cap. The pocket is now ready for use.

Figure 16:
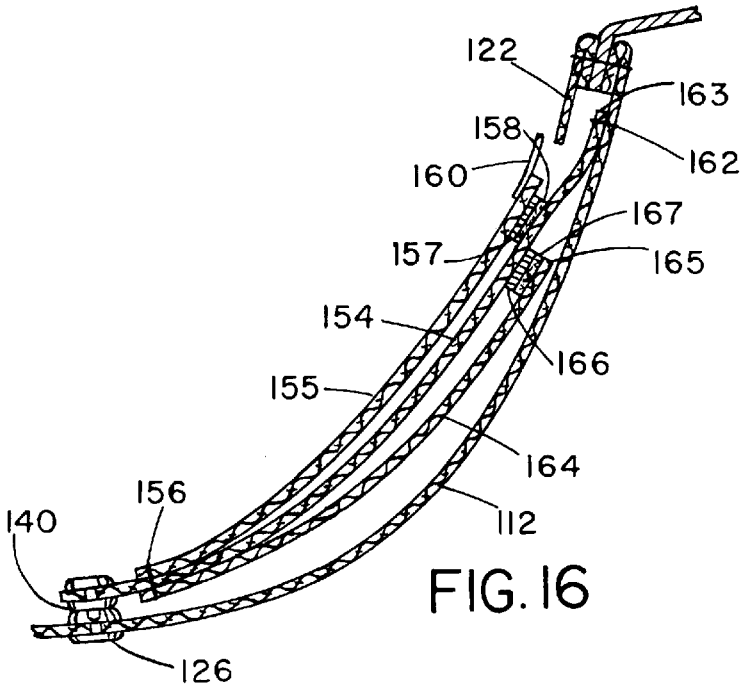
FIG. 16 is a cross-section simiilar to FIG. 15 illustrating another embodiment of a partially detachable pocket.

FIG. 16 illustrates a modified pocket attachment to a hat 110 similar to the hat of the previous embodiments. In this case, the pocket is formed between an inner pocket layer 154 and an outer pocket layer 155 which are sewn together along side seams (not illustrated) and at the apex via stitching 156. The outer layer 155 is detachably fastened to the inner layer 154 by mating strips 157, 158 of hook and loop fastener material along the lower edge of the pocket, in order to provide access to the interior of the pocket, as in previous embodiments. A pull tab 160 on the outer panel can be gripped and pulled by a user to open the pocket as needed. In this embodiment, the inner pocket layer 154 is permanently secured to the hat by stitching 162 only along the lower edge 163, adjacent the peripheral edge of the hat, and a snap fastener assembly 140 is provided between the layer 154 and the hat button 126, as in the previous embodiment. Thus, as in the previous embodiment, the pocket may be detached at the apex and folded down about stitching 162 away from the cap panels, so that the front cap panels may be readily embroidered. When embroidery is complete, the pocket is reattached at snap fastener 140.

The pocket in this case may be attached only along stitching 162 and at the apex via snap fastener 140. Alternatively, mating strips of fastener material may be provided between the inner face of inner layer 154 and the underlying cap panels for a more secure attachment. In this embodiment, a third layer 164 is secured to the inside of inner pocket layer 154 by stitching or the like, with one edge 165 of the inner layer being unsewn, and releasably secured to the inside of layer 154 by mating Velcro strips 166, 167 or the like. This provides a hidden inner pocket where items may be stored more securely than in the outer pocket. When the pocket is fully secured to the inside of the hat, the inner pocket formed by layer 164 will not be visible.

Figure 17:
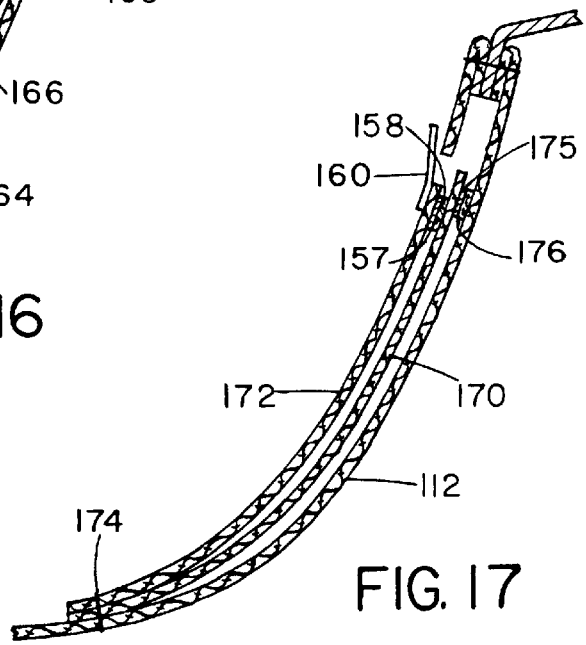
FIG. 17 is a cross-section similar to FIG. 16 illustrating another modified pocket.

FIG. 17 illustrates a modified, two layer detachable pocket which is partially releasable from the inside of hat 112. As in the previous embodiment, the pocket is formed between an inner pocket layer 170 and an outer pocket layer 172 which are sewn together along all sides apart from along their lower edges, where the outer layer is releasably secured to the inner layer via Velcro® strips 157, 158 as in the previous embodiment, and the pocket may be opened by gripping and pulling pull tab 160. Unlike the previous embodiment, the pocket layers are permanently secured via stitching 174 to the crown of the hat. The lower edge of the inner pocket layer 170 is releasably secured to the hat adjacent the peripheral edge of the hat via mating strips 175, 176 of hook and loop fastener material on the inner face of layer 170 and the underlying face of the cap panels 112. The sides of the pocket may also be releasably secured via mating strips of hook and loop fastener material, as in the embodiments of FIGS. 13 to 15, or may be completely unattached. As in the previous embodiment, the pocket is permanently attached to the hat at one end only, in this case the closed end or apex, and is releasably secured at the opposite end, in this case the open end of the pocket. The pocket may be detached at strips 175, 176 and folded up away from the front portion of the hat to allow the front portion to be embroidered. Subsequently, it is folded back down against the inside of the hat and secured as illustrated in FIG. 17, where it is ready for use. The partially detachable pockets of FIGS. 13 to 17 are illustrated as triangular in shape. However, it will be understood that these pockets may alternatively be square or rectangular, as in FIGS. 4 and 5.

In each case, the pocket is positioned in the so-called "dead space" of the hat, which extends from a position just above a wearer's eyebrows over the entire crown of the head. Typically, when a hat or cap is worn, it will grip around the periphery of the wearer's head along the hat band or sweat band. However, due to the difference in curvature between the wearer's head and the hat, as noted above, there will be a space between the wearer's head and the hat in locations above the sweatband. The pocket may extend from a location spaced above the sweatband up to a location close to the top or crown of the hat, and may be confined to the forward portion of the hat, as in the above embodiments. Alternatively, a larger pocket may be provided in an equivalent manner which extends across the entire top of the hat from the front to the rear and around the sides of the hat, with all portions of the pocket suitably spaced above the sweatband.

By positioning the pocket in the dead space, the looks of the hat will not be affected by items placed in the pocket, and the wearer will not experience any discomfort since the pocket contents are held away from the head.

In all cases, the pocket is preferably closed by easily releasable, mating strips of hook and loop type material, such as Velcro®, and a pull tab may be secured to the rim of the pocket to allow the user to open the pocket readily. Other fasteners such as zippers may alternatively be used.

Although some preferred embodiments of the invention have been described above by way of example only, it will be understood by those skilled in the field that modifications may be made to the disclosed embodiments without departing from the scope of the invention, which is defined by the appended claims.

I claim:

1. A hat, comprising:

a head covering member shaped for forming a hat for covering part of the head of a wearer and having a first peripheral edge defining a head receiving opening, a front portion, a rear portion, opposite side portions, and a crown for covering the crown of a wearer's head, the head covering member having an outer face and an inner face;

a pocket located on the inner face of the head covering member, the pocket extending from a location spaced above the peripheral edge in the front portion of the head covering member upwardly towards the crown, the pocket having an access opening forming an open end and a closed end spaced from the access opening; and the pocket being secured to the inner face of the head covering member at least at said open end and said closed end of the pocket.

2. The hat as claimed in claim 1, wherein the pocket is releasably secured to the head covering member at least at one end of the pocket.

3. The hat as claimed in claim 2, wherein the hat has a sweat band secured around the peripheral edge on the inner side of the head covering member, the sweat band having an upper free edge, and the pocket access opening is located below the upper, free edge of the sweat band and behind the sweatband.

4. The hat as claimed in claim 3, wherein the pocket is permanently secured to the head covering member at said open end and the closed end of the pocket is releasably secured to the head covering member at the crown.

5. The hat as claimed in claim 3, wherein the closed end of the pocket is permanently secured to the head covering member at the crown and the open end is releasably secured to the head covering member.

6. The hat as claimed in claim 2, wherein the pocket comprises a single pocket layer secured to the head covering member, whereby the pocket is formed between the pocket layer and head covering member.

7. The hat as claimed in claim 2, wherein the pocket comprises an inner pocket layer and an outer pocket layer secured together to form said pocket.

8. The hat as claimed in claim 1, wherein the pocket is triangular and the closed end of the pocket comprises an apex of the triangular pocket, and the apex of the pocket is secured to the crown of the head covering member.

9. The hat as claimed in claim 8, wherein the head covering member comprises a single layer and the pocket comprises a single, triangular shaped layer secured to the head covering layer, whereby the pocket is formed between the pocket layer and head covering layer.

10. The hat as claimed in claim 9, wherein the head covering member comprises a series of triangular panels having opposite side edges secured to adjacent panels to form seams, and the triangular pocket layer has opposite side edges secured along seams of the head covering member.

11. The hat as claimed in claim 10, wherein the pocket layer is permanently secured along said seams.

12. The hat as claimed in claim 10, wherein the pocket layer is releasably secured to the head covering member along at least said seams and one end of said pocket, whereby the pocket can be separated from the head covering member along said one end of said pocket and said seams.

13. The hat as claimed in claim 8, wherein the head covering member has a button at said crown, and the apex of the pocket is secured to said button.

14. The hat as claimed in claim 13, wherein the head covering member has an inwardly facing, first snap fastener part and the apex of the pocket has a second snap fastener part for releasable snap engagement in said first snap fastener part.

15. The hat as claimed in claim 1, wherein the head covering member comprises separate inner and outer layers, and the inner layer is secured to the outer layer along seams to form said pocket.

16. The hat as claimed in claim 1, wherein the pocket comprises an inner pocket layer and an outer pocket layer secured to said head covering member.

17. The hat as claimed in claim 1, wherein the head covering member comprises a plurality of triangular panels secured together along adjacent side edges to form seams, and pocket is triangular and is secured to the head covering member along two of said seams.

18. The hat as claimed in claim 17, wherein the pocket is secured to the crown of the hat at an apex of the pocket.

19. The hat as claimed in claim 18, wherein the pocket is releasably secured to the head covering member along said seams and at said apex, whereby the pocket can be separated from the head covering member from said apex and along said seams.

20. The hat as claimed in claim 18, wherein the pocket is releasably secured to the head covering member along said open end and said seams, and permanently secured at said apex, whereby the pocket can be separated from the head covering member along said open end and seams.

21. A hat, comprising:

a head covering member adapted for forming a hat for covering part of the head of a wearer and having a first peripheral edge defining a head receiving opening, a front portion, a rear portion, opposite side portions, and a crown for covering the crown of a wearer's head, the head covering member having an outer face and an inner face;

a pocket located at the inner face of the head covering member, the pocket extending from a location spaced above the peripheral edge in the front portion of the head covering member upwardly towards the crown, whereby at least the majority of the pocket is located entirely within a dead space of the head covering member which is designed to be above a wearer's eyebrows and not contact the wearer's head when the hat is worn, the pocket having an access opening;

the head covering member including an outer layer and a separate inner liner layer secured to the outer layer at least over the front portion of the head covering member, the liner layer having an opening at a location spaced above said peripheral edge defining said pocket access opening, and said inner and outer layers being secured together along seams extending from said opening to form said pocket; and the pocket being generally triangular in shape.

22. The hat as claimed in claim 21, wherein an apex of the pocket is located adjacent the crown of the hat.

23. The hat as claimed in claim 22, wherein an apex of the pocket is secured to the crown of the hat.

24. The hat as claimed in claim 21, wherein said inner and outer layers are releasably secured together along said seams, whereby the inner layer forming the pocket may be pulled away from the outer layer to allow said outer layer to be embroidered.

25. The hat as claimed in claim 24, including a snap fastener for releasably securing the apex of the pocket to the crown of the hat.

26. A hat, comprising:

a head covering member adapted for forming a hat for covering part of the head of a wearer and having a first peripheral edge defining a head receiving opening, a front portion, a rear portion, opposite side portions, and a crown for covering the crown of a wearer's head, the head covering member having an outer face and an inner face, the head covering member comprising a single hat layer;

a pocket located at the inner face of the head covering member, the pocket extending from a location spaced above the peripheral edge in the front portion of the head covering member upwardly towards the crown, whereby at least the majority of the pocket is located entirely within a dead space of the head covering member which is designed to be above a wearer's eyebrows and not contact the wearer's head when the hat is worn, the pocket having an access opening;

a releasable fastener for releasably closing the pocket opening; and the pocket having a peripheral edge and being secured to the inner face of said hat layer around at least part of the peripheral edge of said pocket.

27. The hat as claimed in claim 26, wherein the pocket is a separate pocket having opposite sides, a bottom fold, and an upper opening, and is secured to the inner face of said hat layer by seams extending along said opposite sides.

28. The hat as claimed in claim 26, including a pull tab secured to said pocket adjacent said opening for pulling by a user to release said releasable fastener for access to said pocket.

29. A hat, comprising:

a head covering member adapted for forming a hat for covering part of the head of a wearer and having a first peripheral edge defining a head receiving opening, a front portion, a rear portion, opposite side portions, and a crown for covering the crown of a wearer's head, the head covering member having an outer face and an inner face;

a pocket located at the inner face of the head covering member, the pocket extending from a location spaced above the peripheral edge in the front portion of the head covering member upwardly towards the crown, whereby at least the majority of the pocket is located entirely within a dead space of the head covering member which is designed to be above a wearer's eyebrows and not contact the wearer's head when the hat is worn, the pocket having an access opening;

a releasable fastener for releasably closing the pocket opening; and the pocket being generally triangular in shape.

30. The hat as claimed in claim 29, wherein an apex of the pocket is located adjacent the crown of the hat.

31. The hat as claimed in claim 30, wherein an apex of the pocket is secured to the crown of the hat.

32. The hat as claimed in claim 29, including a pull tab secured to said pocket adjacent said opening for pulling by a user to release said releasable fastener for access to said pocket.

* * * * *